US006869115B2

(12) United States Patent
Shen

(10) Patent No.: US 6,869,115 B2
(45) Date of Patent: Mar. 22, 2005

(54) INSIDE ROSE LINER FOR A DOOR LOCK

(76) Inventor: Mu-Lin Shen, No. 18, Gong-Yeh 3 Road, An-Nan District, Tainan (TW)

( * ) Notice: Subject to any disclaimer, the term of this patent is extended or adjusted under 35 U.S.C. 154(b) by 0 days.

(21) Appl. No.: 10/434,729

(22) Filed: May 9, 2003

(65) Prior Publication Data

US 2004/0222648 A1 Nov. 11, 2004

(51) Int. Cl.[7] ..... E05B 15/02
(52) U.S. Cl. ..... 292/357; 292/DIG. 53
(58) Field of Search ..... 292/336.3, 357, 292/DIG. 53, DIG. 64, DIG. 60

(56) References Cited

U.S. PATENT DOCUMENTS 470,072 A * 3/1892 Ormsby ..... 292/357
4,784,418 A * 11/1988 Pearson et al. ..... 292/348
4,921,289 A * 5/1990 Shen ..... 292/336.3
4,930,822 A * 6/1990 Shen ..... 292/357
5,490,700 A * 2/1996 Zuckerman ..... 292/357
5,961,162 A * 10/1999 Glaser et al. ..... 292/198
6,302,457 B1 * 10/2001 Shen ..... 292/357
6,364,383 B1 * 4/2002 Shen ..... 292/357

* cited by examiner

*Primary Examiner*—Gary Estremsky
(74) *Attorney, Agent, or Firm*—Alan Kamrath; Nikolai & Mersereau PA

(57) ABSTRACT

A door lock includes a main body having an inside seat and an outside seat. The inside seat includes two diametrically disposed flat surfaces and two arcuate surfaces. An inside rose liner is mounted around the inside seat and includes a central hole. A wall projects from a periphery delimiting the central hole and extends along a direction parallel to a longitudinal axis of the main body. The wall includes two diametrically disposed flat sections respectively engaged with the flat surfaces of the inside seat. The wall further includes two arcuate sections respectively engaged with the arcuate surfaces of the inside seat. Thus, the torque-bearing capacity of the door lock is improved.

4 Claims, 4 Drawing Sheets

INSIDE ROSE LINER FOR A DOOR LOCK

BACKGROUND OF THE INVENTION

1. Field of the Invention

The present invention relates to an inside rose liner for a door lock. In particular, the present invention relates to an inside rose liner for improving the torque-resistant capacity of the door lock.

2. Description of the Related Art

A typical door lock includes a main body having an inside seat and an outside seat, an inside rose liner securely mounted to the inside seat, an outside rose liner securely mounted to the outside seat, an inside rose, an outside rose, an inside handle, and an outside handle. The inside handle and the outside handle of lever type are convenient to the disabled. The inside seat includes two diametrically disposed grooves, and the inside rose liner includes two diametrically disposed protrusions respectively engaged in the grooves of the inside seat. Similar design is adopted in the outside seat and the outside rose liner. The door lock of such a structure is simple and has a low manufacture cost. Nevertheless, the torque resulting from the force applied to the lever type handle for opening the door is relatively greater than that of a knob type handle. The simple engagement of the grooves and protrusions between the respective rose liner and the respective seat is insufficient to resist the torque if lever type handles are used. As a result, the inner parts of the door lock using lever type handles are apt to be damaged.

U.S. Pat. No. 6,302,457 discloses an easy-to-install door lock with improved anti-torque effect for the outside rose assembly, wherein the inside seat of the main body of the door lock includes an outer threading for threadedly engaging with a pull-resisting ring. The inside seat further includes two diametrically disposed flat surfaces, and the inside rose liner includes a central hole having two diametrically disposed flat sections, allowing the inside rose liner to be mounted around the inside seat without the risk of relative rotation. The outside seat includes an outer threading for threadedly engaging with the outside rose liner. Further, the outside seat includes two diametrically disposed flat surfaces, and an anti-torque ring includes a central hole having two diametrically disposed flat sections, allowing the anti-torque ring to be mounted around the outside seat without the risk of relative rotation.

U.S. Pat. No. 6,364,383 discloses an easy-to-install door lock with burglar-proof effect for the outside rose assembly, wherein each of the inside seat and the outside seat of the main body of the door lock includes two diametrically disposed flat surfaces. Further, the inside rose liner includes a threaded inner periphery for threadedly engaging with an outer threading of the inside seat. An anti-torque ring is engaged on the outside seat for improving the torque-bearing capacity. The anti-torque ring has a central hole having two diametrically disposed flat sections, allowing the anti-torque ring to be mounted around the outside seat without the risk of relative rotation.

However, the threading arrangements of the door locks disclosed in U.S. Pat. Nos. 6,302,457 and 6,364,383 require additional processing and thus fail to provide a simple structure while resulting in an increase in the cost.

SUMMARY OF THE INVENTION

An object of the present invention is to provide a door lock having an inside rose liner for improving the torque-resistant capacity of the door lock.

A door lock in accordance with the present invention includes a main body having an inside seat and an outside seat. The inside seat includes two diametrically disposed fiat surfaces and two arcuate surfaces. An inside rose liner is mounted around the inside seat and includes a central hole. A wall projects from a periphery delimiting the central hole and extends along a direction parallel to a longitudinal axis of the main body. The wall includes two diametrically disposed flat sections respectively engaged with the flat surfaces of the inside seat. The wall further includes two arcuate sections respectively engaged with the arcuate surfaces of the inside seat. Thus, the torque-bearing capacity of the door lock is improved.

In a preferred embodiment of the invention, the inside rose liner includes at least two pairs of diametrically disposed positioning holes spaced apart from each other, and two screws are selectively extended through one of the pairs of said at least two pairs of the diametrically disposed positioning holes into the positioning posts of an outside rose liner. This allows the door lock in accordance with the present invention to be mounted to a door with positioning holes that are located in a position other than the vertical position. Drilling for forming additional holes in the door is not required.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
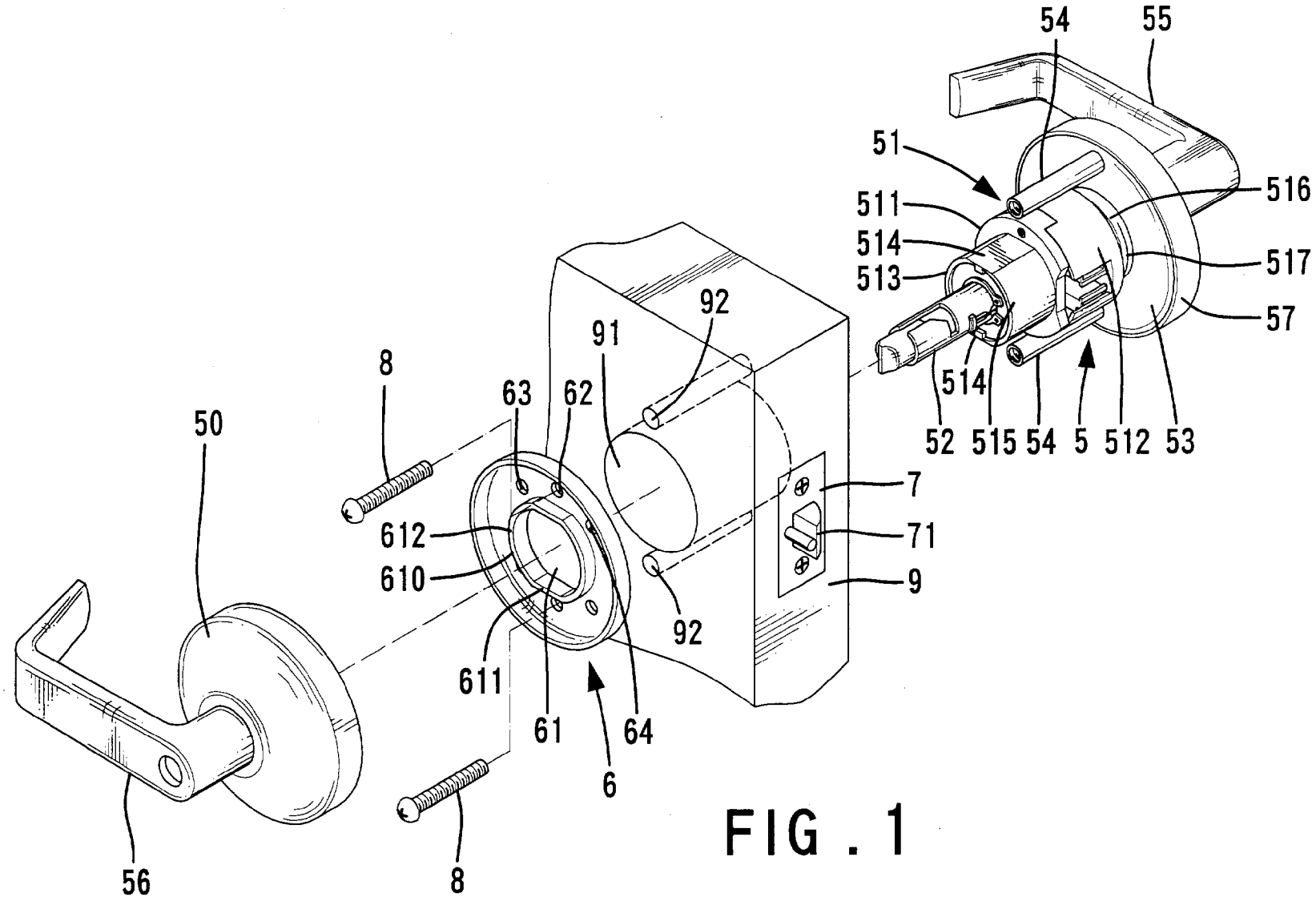
FIG. 1 is an exploded perspective view of a portion of a door and a door lock in accordance with the present invention.
Figure 2:
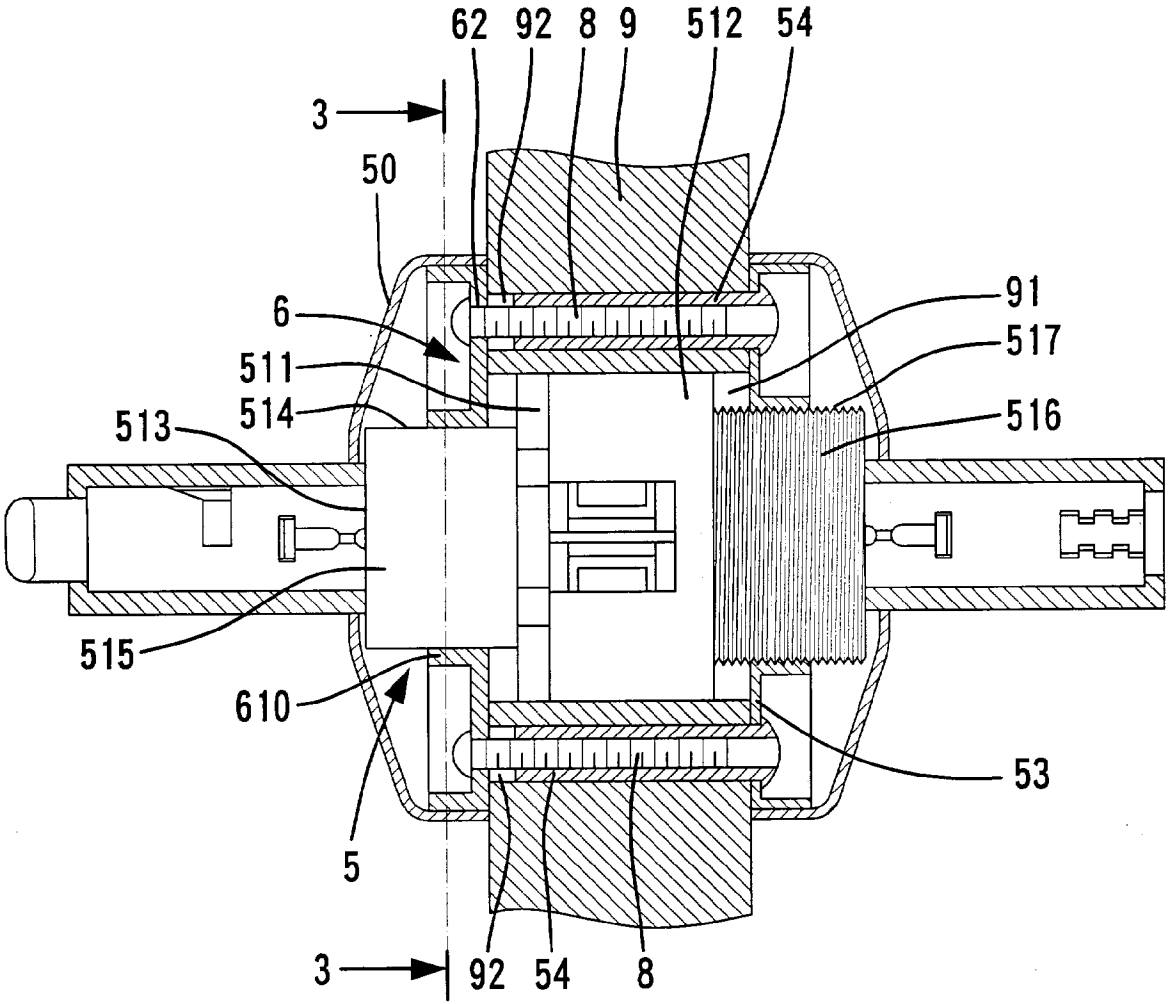
FIG. 2 is a sectional view of the door lock in accordance with the present invention mounted to the door.
Figure 3:
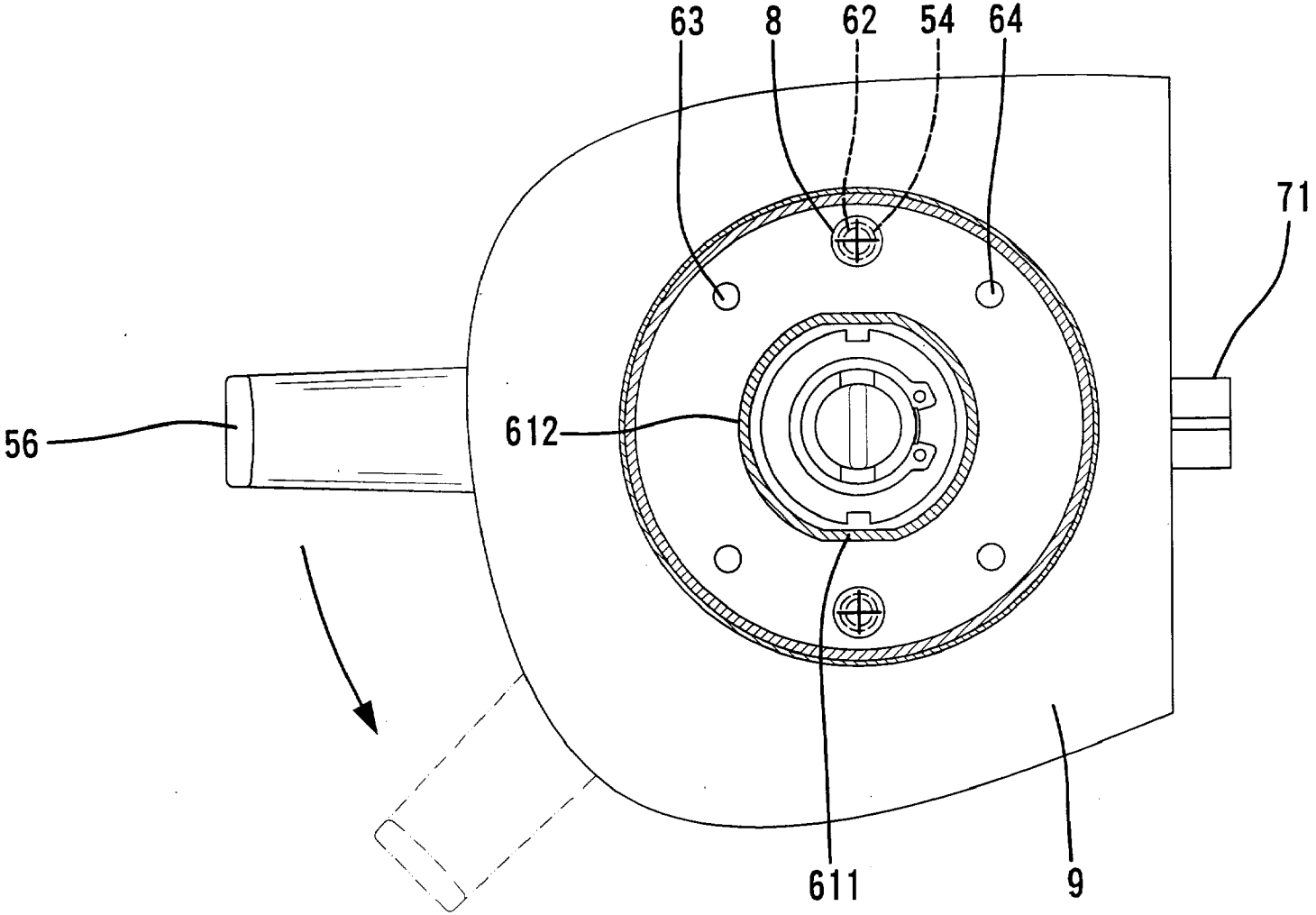
FIG. 3 is a sectional view taken along line 3—3 in FIG. 2.

Referring to FIGS. 1 through 3, a door lock 5 in accordance with the present invention generally comprises a main body 51 to be mounted in a mounting hole 91 of a door 9. The door lock 5 further includes an inside rose 50, an outside rose 57, an inside handle 56, and an outside handle 55. The inside handle 56 and the outside handle 55 are of lever type, which is convenient to the disabled.

The main body 51 includes an inside positioning assembly 51 having an inside seat 513 and an outside positioning assembly 512 having an outside seat 516. The inside seat 513 includes two diametrically disposed flat surfaces 514 and two diametrically disposed arcuate surfaces 515. The outside seat 516 has an outer threading 517. The main body 51 further includes a transmission assembly 52 mounted thereto. Turning of either handle 55, 56 causes retraction of a latch bolt 71 of a latch assembly 7 through transmission by the transmission assembly 52, which is conventional. An outside rose liner 53 is mounted around the outside seat 516 and inside the outside rose 57. Two positioning posts 54 extend from an inner side of the outside rose liner 53 and through two positioning holes 92 in the door 9, and two screws 8 are extended from an inner side of the door 9 into screw holes (not labeled) of the positioning posts 54, which is also conventional.

An inside rose liner 6 is mounted around the inside seat 513 and inside the inside rose 50. The inside rose liner 6 includes a central hole 61 configured to be mounted around the inside seat 513 in a manner that rotation of the inside rose liner 6 relative to the inside seat 513 is not permitted. A wall 610 projects from a periphery delimiting the central hole 61 and extends along a direction parallel to a longitudinal axis of the main body 51. The wall 610 includes two diametrically disposed flat sections 611 for engaging with the flat surfaces 514 of the inside seat 513 and two diametrically disposed arcuate sections 612 for engaging with the arcuate surfaces 515 of the inside seat 513. The arcuate sections 612 and the flat sections 611 are alternately arranged.

The inside rose liner 6 further includes a first pair of diametrically disposed positioning holes 63, a second pair of diametrically disposed positioning holes 62, and a third pair of diametrically disposed positioning holes 64, wherein the respective positioning hole 62 is spaced apart from the respective positioning hole 63 by e.g., 45 degrees, and wherein the respective positioning hole 64 is spaced apart from the respective positioning hole 62 by e.g., 45 degrees. In this embodiment, the positioning holes 62 are located in the vertical direction, with the respective positioning holes 63 and 64 located on both sides of the respective positioning holes 62.

Referring to FIGS. 1 through 3, the outside rose liner 53 is mounted around the outside seat 516 of the main body 5 and then turned in response to the thickness of the door 9. Namely, the position of the outside rose liner 53 relative to the outside seat 516 along the longitudinal axis of the main body 5 is adjusted until the latch mechanism 7 reaches a predetermined position. Next, the main body 5 is mounted into the mounting hole 91 of the door 9. The positioning posts 54 are then extended through the positioning holes 92 of the door 9. Then, the screws 8 are extended through the positioning holes 62 of the inside rose liner 6 into the screw holes of the positioning posts 54, thereby tightly pressing the inside rose liner 6 against an inner side of the door 9 and tightly pressing the outside rose liner 53 against the outer side of the door 9. It is noted that the handles 55 and 56 are located in a horizontal position. When either handle 55, 56 is turned, the latch bolt 71 is retracted via transmission by the transmission assembly 52.

The wall 610 of the inside rose liner 6 increases the contact area between the inside rose liner 6 and the inside seat 513. The flat sections 611 of the wall 610 engaged with the flat surfaces 514 of the inside seat 513 and the arcuate sections 612 of the wall 610 engaged with the arcuate surfaces 515 of the inside seat 513 prevent rotation of the inside rose liner 6 relative to the main body 5. Thus, the inside rose liner 6 provides improved torque-bearing capacity.

Figure 4:
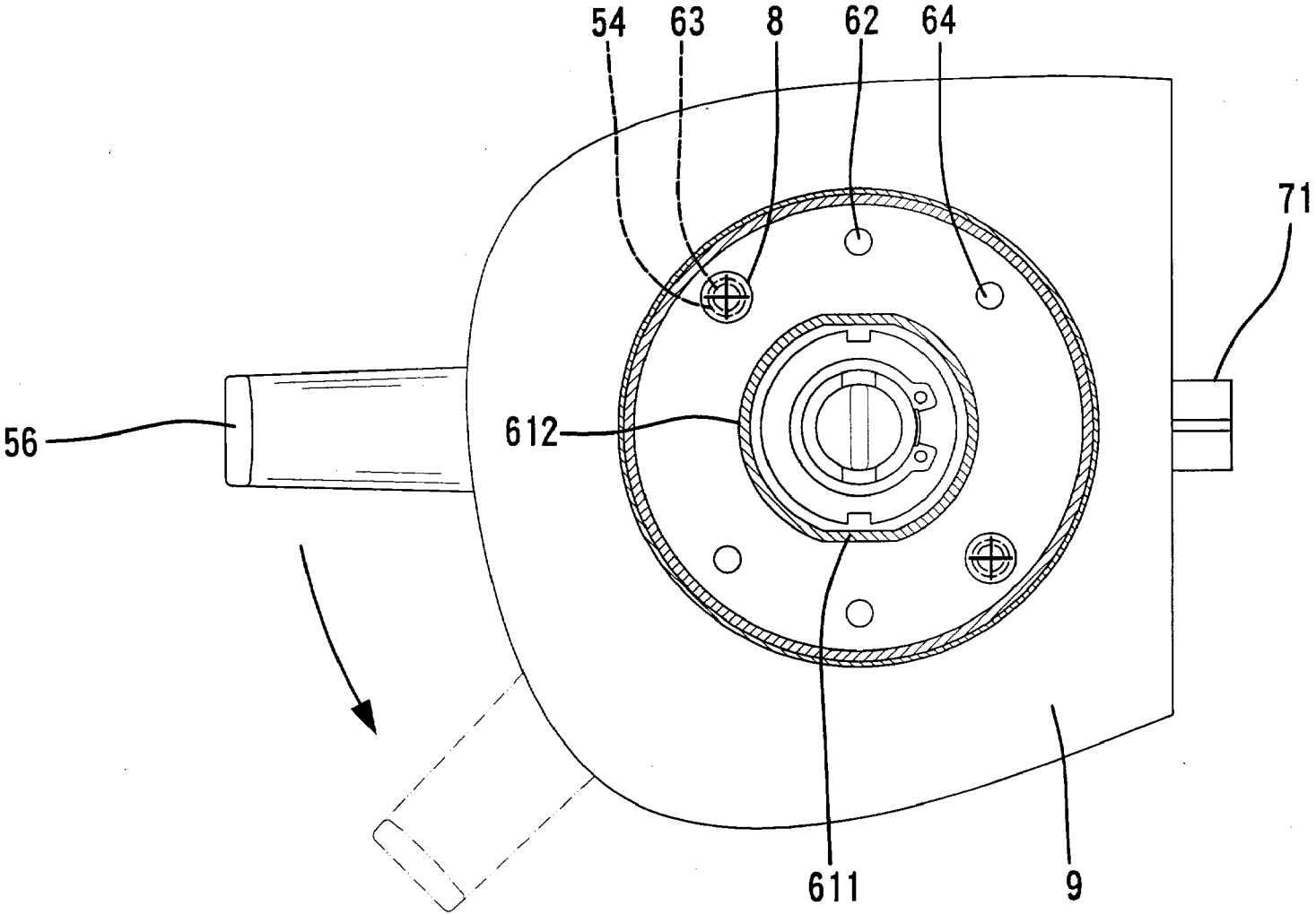
FIG. 4 is a sectional view similar to FIG. 3, illustrating different mounting position of an inside rose liner of the door lock.

Referring to FIG. 4, when the positioning holes (not shown) of the door 9 are oriented in a position other than the vertical position shown in FIG. 1, the outside rose liner 53 is turned until the positioning posts 54 are aligned with the positioning holes of the door 9. Next, the screws 8 are extended through another pair of positioning holes, e.g., the positioning holes 63 that are aligned with the positioning holes of the door 9. The subsequent procedure for mounting the door lock is substantially the same as that for mounting the door lock to a door 9 with vertically oriented positioning holes 92 shown in FIG. 1. This allows the door lock in accordance with the present invention to be mounted to a door 9 with positioning holes that are located in a position other than the vertical position shown in FIG. 1. Drilling for forming additional holes in the door 9 is not required.

Although the invention has been explained in relation to its preferred embodiment, it is to be understood that many other possible modifications and variations can be made without departing from the scope of the invention as hereinafter claimed.

What is claimed is:

1. A lock for a door comprising:

a main body including an inside seat and an outside seat, the inside seat including two diametrically disposed flat surfaces and two arcuate surfaces;

a transmission assembly rotatably mounted along a longitudinal axis within the main body;

an outside rose mounted around the outside seat; and an inside rose liner mounted around the inside seat, the inside rose liner including a body portion having a central hole and a wall projecting away from the body portion at the central hole in a direction parallel to the longitudinal axis of the main body, the wall including two diametrically disposed flat sections respectively engaged with the flat surfaces of the inside seat, the wall further including two arcuate sections respectively engaged with the arcuate surfaces of the inside seat, with the inside and outside rose liners being adapted to be secured together on opposite sides of the door.

2. The door lock as claimed in claim 1, with the outside seat including an outer threading, with the outside rose liner being threadedly engaged with the outer threading of the outside seat, allowing adjustment of a position of the outside rose liner along the longitudinal axis of the main body relative to the outside seat.

3. The door lock as claimed in claim 2, with the outside rose liner including two positioning posts extending from an inner side thereof, with the inside rose liner including a pair of diametrically disposed positioning holes, and with two screws extending through the positioning holes into the positioning posts of the outside rose liner.

4. The door lock as claimed in claim 2, with the outside rose liner including two positioning posts extending from an inner side thereof, with the inside rose liner including at least two pairs of diametrically disposed positioning holes spaced apart from each other, and with two screws selectively extending through one of said at least two pairs of diametrically disposed positioning holes into the positioning posts of the outside rose liner.

* * * * *